United States Patent [19]

El-Sayed et al.

[11] Patent Number: 4,917,985

[45] Date of Patent: Apr. 17, 1990

[54] ORGANIC SULFUR-CONTAINING COMPOUNDS AS ADJUVANTS FOR POSITIVE ELECTROSTATIC LIQUID DEVELOPERS

[75] Inventors: Lyla M. El-Sayed, West Chester, Pa.; Torence J. Trout, Yorklyn, Del.

[73] Assignee: E. I. Du Pont de Nemours and Company, Wilmington, Del.

[21] Appl. No.: 292,291

[22] Filed: Dec. 30, 1988

[51] Int. Cl.[4] ..... G03G 9/12

[52] U.S. Cl. ..... 430/114; 430/115; 430/116; 430/137

[58] Field of Search ..... 430/114, 115, 116, 137

[56] References Cited

U.S. PATENT DOCUMENTS

| | | | |
|---|---|---|---|
| 4,138,351 | 6/1979 | Gilliams et al. | 430/114 |
| 4,259,428 | 3/1981 | Tsuneda | 430/115 |
| 4,425,418 | 1/1984 | Iwaki et al. | 430/106 |
| 4,681,831 | 7/1987 | Larson et al. | 430/114 |
| 4,702,984 | 10/1987 | El-Sayed et al. | 430/115 |
| 4,702,985 | 10/1987 | Larson | 430/115 |
| 4,734,352 | 3/1988 | Mitchel | 430/115 |
| 4,758,494 | 7/1988 | El-sayed | 430/137 |
| 4,760,009 | 7/1988 | Larson | 430/137 |
| 4,772,528 | 9/1988 | Larson et al. | 430/114 X |
| 4,780,389 | 10/1988 | El-Sayed | 430/115 |
| 4,783,388 | 11/1988 | El-Sayed et al. | 430/115 |
| 4,798,778 | 1/1989 | El-Sayed et al. | 430/115 |
| 4,820,605 | 4/1989 | El-Sayed | 430/115 |

FOREIGN PATENT DOCUMENTS

| | | | |
|---|---|---|---|
| 47-8756 | 3/1969 | Japan | 430/115 |
| 50-99329 | 8/1975 | Japan | 430/115 |

*Primary Examiner*—Paul R. Michl
*Assistant Examiner*—Jeffrey A. Lindeman

[57] ABSTRACT

Positive electrostatic liquid developer consisting essentially of (A) nonpolar liquid having Kauri-butanol value less than 30, present in major amount, (B) thermoplastic resin particles having an organic sulfur-containing compound which is substantially insoluble in the nonpolar liquid at ambient temperatures, as defined dispersed therein and average particle size by area being less than 10 μm, and (C) nonpolar liquid soluble ionic or zwitterionic charge director compound. Optionally a colorant and charge adjuvant are present. The electrostatic liquid developer is useful in copying, making proofs including digital color proofs, lithographic printing plates, and resists.

50 Claims, No Drawings

ORGANIC SULFUR-CONTAINING COMPOUNDS AS ADJUVANTS FOR POSITIVE ELECTROSTATIC LIQUID DEVELOPERS

DESCRIPTION

1. Technical Field

This invention relates to electrostatic liquid developers. More particularly this invention relates to a positive-working liquid electrostatic developer containing resin particles having dispersed therein certain organic sulfur-containing compounds.

2. Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 $\mu$m average by area size as measured by a Horiba CAPA-500 centrifugal automatic particle analyzer. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polybutylene succinimide, an aromatic hydrocarbon, etc., to the liquid toner comprising the thermoplastic resin, dispersant nonpolar liquid, and preferably a colorant. Such liquid developers provide images of good resolution, but it has been found that charging and image quality are particularly pigment dependent. Some formulations, suffer from poor image quality manifested by low resolution, poor solid area coverage (density), and/or image squash. In order to overcome such problems much research effort has been expended to develop new type charge directors and/or charging adjuvant for electrostatic liquid toners or developers.

It has been found that the above disadvantages can be overcome and improved positive electrostatic liquid developers prepared containing a dispersant nonpolar liquid, ionic or zwitterionic charge director compound, a thermoplastic resin, and preferably a colorant and an adjuvant as described below. The improved electrostatic liquid developer when used to develop an electrostatic image results in improved image quality, reduced squash, and improved solid area coverage independent of the pigment and charge director compound present.

DISCLOSURE OF THE INVENTION

In accordance with this invention there is provided a positive electrostatic liquid developer having improved charging and imaging characteristics consisting essentially of (A) a nonpolar liquid having a Kauri-butanol value of less than 30, present in a major amount, (B) thermoplastic resin particles having dispersed therein an adjuvant which is substantially insoluble in the nonpolar liquid at ambient temperatures and is an organic sulfur-containing compound selected from the group consisting of (1)

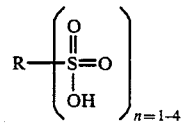

(2)

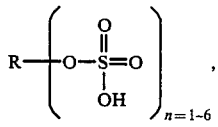

(3)

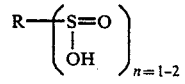

and (4) the salts of (1), (2) and 3, wherein R is alkyl of 1 to 30 carbon atoms, substituted alkyl of 1 to 30 carbon atoms, aryl of 6 to 30 carbon atoms, substituted aryl of 6 to 30 carbon atoms, the resin particles having an average by area particle size of less than 10 $\mu$m, and (C) a nonpolar liquid soluble ionic or zwitterionic charge director compound.

In accordance with an embodiment of this invention there is provided a process for preparing a positive electrostatic liquid developer for electrostatic imaging comprising (A) dispersing at an elevated temperature in a vessel a thermoplastic resin, an organic sulfur-containing compound selected from the group consisting of (1)

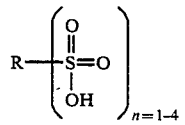

(2)

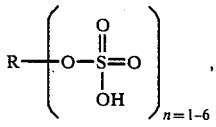

(3)

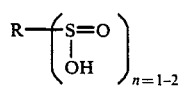

and (4) the salts of (1), (2) and 3, wherein R is alkyl of 1 to 30 carbon atoms, substituted alkyl of 1 to 30 carbon atoms, aryl of 6 to 30 carbon atoms, substituted aryl of 6 to 30 carbon atoms, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particular media with or without the presence of additional liquid; or (3) while grinding by means of particulate media to prevent the formation of a gel or solid mass with or without the presence of additional liquid;

(C) separating the dispersion of toner particles having an average by area particle size of less than 10 μm from the particulate media, and (D) adding to the dispersion during or subsequent to Step (A) a nonpolar liquid soluble ionic or zwitterionic charge director compound.

Throughout the specification the below-listed terms have the following meanings:

In the claims appended hereto consisting essentially of means the composition of the electrostatic liquid developer does not exclude unspecified components which do not prevent the advantages of the developer from being realized. For example, in addition to the primary components, there can be present additional components, such as a colorant, fine particle size oxides, adjuvants, e.g., polybutylene succinimide, aromatic hydrocarbon, alkyl hydroxybenzylpolyamine, etc.

Q/m is the charge to mass ratio expressed as micro Coulombs/gram.

Conductivity is the conductivity of the developer measured in pmhos/cm at 5 hertz and 5 volts and can be referred to as BULK.

Grey Scale means a step wedge where the toned image density increased from $D_{min}$ to $D_{max}$ in constant increments.

The dispersant nonpolar liquids (A) are, preferably, branched-chain aliphatic hydrocarbons and more particularly, Isopar®-G, Isopar®-H, Isopar®-K, Isopar®-L, and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° and 197° C., Isopar®-L between 188° C. and 206° and Isopar®-M between 207° C. and 254° C. and a mid-boiling point of approximately 194° C. Isopar®-M has a flash point of 80° and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp. (°C.) |
|---|---|---|
| Norpar® 12 | 69 | 204 |
| Norpar® 13 | 93 | 210 |

-continued

| Liquid | Flash Point (°C.) | Auto-Ignition Temp. (°C.) |
|---|---|---|
| Norpar® 15 | 118 | 210 |

All of the dispersant nonpolar liquids have an electrical volume resistivity in excess of $10^9$ ohm centimeters and dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. In the preparation of liquid developer the ratio of thermoplastic resin to nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the ingredients described more fully below such as the resin, including components dispersed therein, e.g., pigment component, adjuvant, etc.

Useful thermoplastic resins or polymers include: ethylene vinyl acetate (EVA) copolymers (Elvax® resins, E. I. du Pont de Nemours and Company, Wilmington, Del.), copolymers of ethylene and an α,β-ethylenically unsaturated acid selected from the group consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. duPont deNemours and Company, Wilmington, Del., etc., or blends thereof, polyesters, polyvinyl toluene, polyamides, styrene/butadiene copolymers and epoxy resins. Terpene polymers such as described in Tsuneda U.S. Pat. No. 4,259,428 cannot be used in this invention because of their relatively high solubility in the nonpolar liquid. Preferred copolymers are the copolymer of ethylene and an α,β-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid number of the copolymers range from 1 to 120, preferably 54 to 90.

Acid no. is milligrams potassium hydroxide required to neutralize 1 gram of polymer. The melt index (g/10 min) of 10 to 500 is determined by ASTM D 1238 Procedure A. Particularly preferred copolymers of this type have an acid no. of 66 and 60 and a melt index of 100 and 500 determined at 190° C., respectively.

The thermoplastic resins described above optionally can have dispersed therein one organic sulfur-containing compound of the following formulas:

(1)

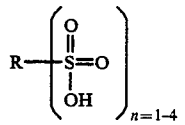

(2)

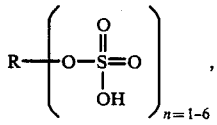

(3)

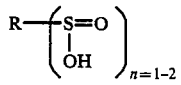

wherein R is alkyl of 1 to 30 carbon atoms, e.g., methyl, ethyl, propyl, butyl, pentyl, hexyl, decyl, dodecyl, hexadecyl, pentadecyl, etc.; substituted alkyl of 1 to 30 carbon atoms and substituted aryl of 6 to 30 carbon atoms, e.g., halogen, e.g., Br, Cl, F; hydroxy; alkoxy of 1 to 30 carbon atoms; aryloxy of 6 to 30 carbon atoms; aryl of 6 to 30 carbon atoms, e.g., benzene, naphthalene, anthracene, pentacene, pentathrene, etc.; and the salts of compounds (1), (2) and (3), wherein the cation may be, for example, Na, K, Ba, Ca, Mg, Mn, Al, $NH_3$, etc. The sulfonic acid, organic sulfonates, organic sulfate, sulfinic acid, or their salts are substantially insoluble in the nonpolar liquid at ambient temperatures.

Suitable types of sulfur-containing compounds include:

sulfonic acid (Structure 1 above)
p-toluene sulfonic acid
Ba salt of p-toluenesulfonic acid
Na salt of 2-bromoethanesulfonic acid
Na salt of 3-hydroxy-1-propanesulfonic acid
benzenesulfonic acid
1-butanesulfonic acid
Na salt of 1-butanesulfonic acid
Na salt of 1-decanesulfonic acid
Na salt of 1-dodecanesulfonic acid
tetradecane sulfonic acid
Na salt of tetradecane sulfonic acid
Na salt of 4-bromo-1-butanesulfonic acid
Na salt of 4-hydroxybutanesulfonic acid
1-pentanesulfonic acid
Na salt of 1-pentanesulfonic acid
Na salt of 1-hexanesulfonic acid
disodium salt of 1,4-butanedisulfonic acid
Mg salt of 1,4-butanedisulfonic acid
Tetra Na salt of 1,3,6,8-pyrene tetrasulfonic acid
2-propanesulfonic acid
Na salt of propanesulfonic acid
tri Na salt of naphthalene-1,3,6-trisulfonic acid
tri Na salt of 8-hydroxy-1,3,6-pyrenetrisulfonic acid, and
tri Na salt of benzenetrisulfonic acid
dodecylbenzenesulfonate
ethanesulfonate
cyclohexylmethanesulfonate organic sulfates (structure 2 above)
decyl sodium sulfate
ammonium lauryl sulfate
Li salt of dodecyl sulfate
Na salt of 3-iodopropyl sulfate
butyl sulfate
Na salt of n-butyl sulfate
pentyl sulfate
n-undecyl sulfate
tri Na salt of estriol trisulfate,
hexa K salt of myo-inositol hexasulfate, and
Na salt of dodecyl sulfate.

sulfinic acid (structure 3 above)
p-toluenesulfinic acid
benzenesulfinic acid
Zn salt of benzenesulfinic acid, and
Na salt of oxy-4,4-bis(benzene-sulfinic acid).

The sulfur-containing compounds are dispersed in the developer solids in an amount of 0.1 to 10 percent by weight, preferably 1 to 5 percent by weight, based on the total weight of the developer solids. A method whereby the sulfur-containing compounds are dispersed in the thermoplastic resin is described below.

In addition, the resins have the following preferred characteristics:

1. Be able to disperse the adjuvant, colorant, e.g., pigment, etc.

2. Be substantially insoluble in the dispersant liquid at temperatures below 40° C., so that the resin will not dissolve or solvate in storage, 3. Be able to solvate at temperatures above 50° C.

4. Be able to form particles between 0.1 μm and 5 μm, in diameter (preferred size), e.g., determined by Horiba CAPA-500 centrifugal particle analyzer; and between about 1 μm and 15 μm, in diameter, e.g., determined by Malvern 3600E Particle Sizer as described below.

5. Be able to form a particle (average by area) of less than 10 μm, e.g., determined by Horiba CAPA-500 centrifugal automatic particle analyzer, manufactured by Horiba Instruments, Inc., Irvine, Calif.: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm, and, about 30 μm average particle size, e.g., determined by Malvern 3600E Particle Sizer as described below, and 6. Be able to fuse at temperatures in excess of 70° C. By solvation in 3. above, the resins forming the toner particles will become swollen, gelatinous or softened.

Suitable nonpolar liquid soluble ionic or zwitterionic charge director compounds (C) which are used in an amount of 0.1 to 10,000 mg/g, preferably 1 to 1,000 mg/g developer solids, include: positive charge directors, e.g., glyceride charge directors such as Emphos® D70-30C and Emphos® F27-85, two commercial products sold by Witco Chemical Corp., New York, N.Y.; which are sodium salts of phosphated mono- and diglycerides with unsaturated and saturated acid substituents, respectively; lecithin, Basic Barium Petronate® Neutral Barium Petronate®, Basic Calcium Petronate®, Neutral Calcium Petronate®, oil-soluble petroleum sulfonate manufactured by Sonneborn Division of Witco Chemical Corp., New York, N.Y., etc.

As indicated above, additional components that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral ® Blue G (C.I. Pigment Blue 15 C.I. No. 74160), Toluidine Red Y (C.I. Pigment Red 3), Quindo ® Magenta (Pigment Red 122), Indo ® Brilliant Scarlet (Pigment Red 123, C.I. No. 71145), Toluidine Red B (C.I. Pigment Red ®), Watchung ® Red B (C.I. Pigment Red 48), Permanent Rubine F6B13-1731 (Pigment Red 184), Hansa ® Yellow (pigment Yellow 98), Dalamar ® Yellow (Pigment Yellow 74, C.I. No. 11741), Toluidine Yellow G (C.I. Pigment Yellow 1), Monastral ® Blue B (C.I. Pigment Blue 15), Monastral ® Green B (C.I. Pigment Green 7) Pigment Scarlet (C.I. Pigment Red 60), Auric Brown (C.I. Pigment Brown 6), Monastral ® Green G (Pigment Green 7), Carbon Black, Sterling ® NS N 774 (Pigment Black 7, C.I. No. 77266), etc.

Fine particle size oxides, e.g., silica, alumina, titania, etc.; preferably in the order of 0.5 μm or less can be dispersed into the liquefied resin. These oxides can be used alone or in combination with the colorants. Metal particles can also be added.

Another additional component of the electrostatic liquid developer is an adjuvant selected from the group consisting of polybutylene succinimide, aromatic hydrocarbon having a Kauri-butanol value of greater than 30, and alkylhydroxybenzylpolyamine. Other adjuvants may be used provided they do not affect the charge. The adjuvants are generally used in an amount of 1 to 1000 mg/g, preferably 1 to 200 mg/g developer solids. Examples of the above-described adjuvants include:

polybutylene succinimide: OLOA ®-1200 sold by Chevron Corp., analysis information appears in Kosel U.S. Pat. No. 3,900,412, column 20, lines 5 to 13, the disclosure of which is incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic ® 100 which is a mixture of $C_9$ and $C_{10}$ alkyl-substituted benzenes manufactured by Exxon Corp., etc.

alkylhydroxybenzylpolyamine compounds of the formula:

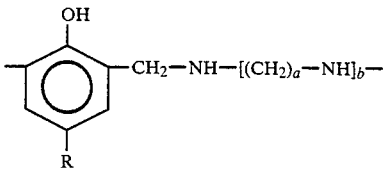

wherein a is 2–8, b is 1–10, and

R is an alkyl group of 1–20,000 carbon atoms, and being soluble in nonpolar liquid.

The above benzyl amine groups (—PN—) are connected by methylene groups to form compounds such as H—PN—$CH_2$—PN—H, H—PN—$CH_2$—NP—H, H—PN—$CH_2$—NP—$CH_2$—PN—H, and the like.

It is preferred that at least some of the R groups have 50 or more carbon atoms. The hydroxy or amine of the alkylhydroxybenzylpolyamine can be further modified. For example, boron halides such as boron trifluoride, boron triiodide and boron trichloride can form an interaction product with the phenolic hydroxy groups, i.e., hydroxy group substituents on a benzene ring. Boron oxide, boron oxide hydrate, boron trifluoride, boron triiodide, boron tribromide, boron trichloride, boric acid, boronic acids (such as alkyl-B-$(OH)_2$ and aryl-B-$(OH)_2$), tetraboric acid, metaboric acid and esters of boric acids can form interaction products with other polar groups such as primary and secondary amino (—$NH_2$ and —NH) groups as well as phenolic hydroxy groups. Suitable such copolymers are commercially available compounds, e.g., copolymers sold by Amoco Petroleum Additives Co., Clayton, Mo. which may differ in molecular weight. Amoco 9250 which is said to have a number average molecular weight in the range of 1600 to 1800 (determined by osmometry) and is made by reacting a polybutene with a phenol to give an alkylphenol which is reacted with a polyamine and an aldehyde. Amoco 595, and Amoco 9250 which are believed to be made by a process similar to the one used to make Amoco 9040, described above. Amoco 595 (sold as 45% surfactant, 30% aromatic hydrocarbon, and oil) and Amoco 9250 (sold as 40–45% surfactant, 36% aromatic hydrocarbon, and oil) have number average molecular weights of about 1000 and 1600 to 1800, respectively. The number average molecular weights can be determined by known osmometry techniques.

The particles in the electrostatic liquid developer have an average by area particle size of less than 10 μm, preferably the average by area particle size is less than 5 μm. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The positive electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., etc., or a two-roll heated mill (no particulate media necessary) are placed at least one of thermoplastic resin, organic sulfur-containing compound and dispersant polar liquid described above. Generally the resin, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the total weight of liquid including nonpolar liquid. The dispersing step is generally accomplished at elevated temperature, i.e., the temperature or ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc., selected from the group consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present until the desired dispersion is achieved, typically 2 hours with the mixture being fluids, the dispersion is cooled, e.g., in the range of 0° C. to 65° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media; or with stirring to form a viscous mixture and grinding by means of particulate media. Cooling can occur as described above with or without the presence of additional liquid. Additional liquid may be added at any step during the preparation of the liquid electrostatic developer to facilitate grinding or to dilute the toner to the appropriate % solids needed for toning. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba centrifugal particle analyzer described above, or other comparable apparatus, are formed by grinding for a relatively short period of time.

Another instrument for measuring average particle sizes is a Malvern 3600E Particle Sizer manufactured by Malvern, Southborough, Mass. which uses laser diffraction light scattering of stirred samples to determine average particle sizes. Since these instruments use different techniques to measure average particle size the readings differ. The following correlation of the average size of toner particles in micrometers (μm) for he two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification, the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to percent by weight, preferably 0.3 to 3.0, and more preferably 0.5 to 2 weight percent with respect to the dispersant nonpolar liquid. One or more ionic or zwitterionic charge director compounds (C), of the type set out above, can be added to impart a positive charge. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with, or subsequent thereto. It is believed that upon addition of the charge director compound some leaching of the organic sulfur-containing compound into the dispersant nonpolar liquid occurs. If an adjuvant compound of a type described above, e.g., polybutylene succinimide, aromatic hydrocarbon, alkylhydroxylbenzylpolyamine, etc., has not been previously added in the preparation of the developer, it can be added prior to or subsequent to the developer being charged. Preferably the adjuvant compound is added after the dispersing step.

Two other process embodiments for preparing the electrostatic liquid developer include:

(A) dispersing a thermoplastic resin, optionally a colorant, and/or one of the organic sulfur-containing compounds of this invention in the absence of a dispersant nonpolar liquid having a Kauri-butanol value of less than 30 to form a solid mass.

(B) shredding the solid mass, (C) grinding the shredded solid mass by means of particulate media in the presence of a liquid taken from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a nonpolar soluble ionic or zwitterionic charge director compound; and (A) dispersing a thermoplastic resin, optionally a colorant, and/or one of the organic sulfur-containing compounds of this invention in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, optionally a colorant, while maintaining the temperature in the vessel at a temperature sufficient to plasticize and liquify the resin and below that at which the dispersant nonpolar liquid degrades and the resin and/or colorant decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formation of a gel or solid mass with or without the presence of additional liquid;

(E) separating the dispersion of toner particles having an average by area particle size of less than 10 μm from the particulate media, and (F) adding additional nonpolar liquid, polar liquid or combinations thereof to reduce the concentration of toner particles to between 0.1 to 15.0 percent by weight with respect to the liquid; and (G) adding to the dispersion a nonpolar soluble ionic or zwitterionic charge director compound.

A preferred mode of the invention is described in Example 1.

INDUSTRIAL APPLICABILITY

The positive liquid electrostatic developers of this invention demonstrate improved image quality, resolution, solid area coverage (density), and toning of fine details, evenness of toning, and reduced squash independent of charge director or pigment present. The particles are exclusively charged positive. The developers of the invention are useful in copying, e.g., making office copies of black and white as well as various colors; highlight color copying or color proofing, e.g., a reproduction of an image using the standard colors yellow, cyan, magenta together with black as desired. In copying and proofing the toner particles are applied to a latent electrostatic image and can be transferred, if desired. Other uses envisioned for the positive liquid electrostatic developers include: digital color proofing, lithographic printing plates and resists.

EXAMPLES

The following controls and examples wherein the parts and percentages are by weight illustrate but do not limit the invention. In the examples the melt indices are determined by ASTM D 1238, Procedure A; the average particle sizes by areas were determined by a Malvern 3600 Particle Size Analyzer, or the Horiba CAPA 500 centrifugal automatic particle analyzer, as indicated; and weight average molecular weights are determined by gel permeation chromatography (GPC). Image quality of the toners of the invention was determined on a modified Savin 870 copier unless specifically noted. This device consists of a Savin 870 copier with the modifications described below.

Mechanical modifications include addition of a pretransfer corona and removing the anodized layer from the surface of the reverse roll while decreasing the diameter of the roll spacers to maintain the same gap between the roll and photoconductor.

Electrical modifications to the copier include:

(1) disconnecting the image density feedback loop from the development electrode and connecting the electrode to a Keithly high voltage supply (Model 247), Keithley, Cleveland, Ohio, (2) connecting a Keithly high voltage supply (Model 247) to the modified reverse roll, and (3) disconnecting the transfer corona and connecting same to a Trek (Model 610) high voltage supply, Trek, Medina, N.Y..

The modified Savin 870 was then used to evaluate both positive and negative toners depending on the voltages and biases used. To evaluate positive toners the copier was run in a positive mode: reversed image target was used with negative transfer corona voltages and positive development bias. The reversed image target consists of white characters and lines, etc. on a black background.

The principal of operation is described below. The photoconductor is charged positive (near 1000 V) by means of the charging corona. The copy is imaged onto the photoconductor inducing the latter to discharge to lower voltages (in order of increasing discharge-black areas and white areas). When adjacent to the toner electrode the photoconductor has fields at its surface such that positive toner particles will deposit at the white imaged areas, and negative toner particles, if present, will deposit at the black imaged areas. If necessary, toner background is removed by the biased reverse roll. The toner is then transferred to paper by the transfer corona (the transfer force due to the negative charge sprayed on the back of the paper). The toner is then thermally fused. Actual voltages and biases used can be found in the examples. lp/mm means line pairs/mm.

Table 1 below contains developer formulation and performance information. Measurement results of the charge to mass ratio in micro Coulombs/gram (Q/m) for each developer is given. The developer Q/m ratios were measured with the following procedure: a light aluminum pan was weighed, placed on the spacers of the cell, and developer was then placed in the cell (filling the volume between the cell base and pan bottom (thickness 0.060 inch (1.52 mm). A 180 pf capacitor is charged to 1000 V, placed across the cell and a Keithley 616 Electrometer, Keithley, Cleveland, Ohio was placed in series with the cell. The developer is deposited for 4 seconds. The total charge flow through the cell was measured on the electrometer which was proportional to the charge of the deposited developer. The pan with the deposited developer was removed from the cell, dried on a hot plate for about 20–30 minutes at 130° C., and the change in weight was recorded using a Mettler balance (AE100), Mettler, Hightstown, N.Y., accurate to 0.1 mg. Q/m is then calculated by the following formula: $Q/m = \Delta Q/\Delta m$. This process is repeated using a voltage of −1000 V to deposit particles of the developer with the opposite polarity. Q/m values are given with the sign of the developer particles. The ± ratio is the ratio of the weights of the deposited positive developer particles to the negative particles.

Table 2 below shows the solubility in nonpolar liquid and the effect achieved by various organic sulfur-containing compounds.

CONTROL 1

The following ingredients were placed in a Union Process IS Attritor, Union Process Company, Akron, Ohio:

| Ingredients | Amount (g) |
|---|---|
| Copolymer of ethylene (89%) and methacrylic acid (11%) melt index at 190° C. is 100, acid no. is 66 | 200.00 |
| Heucophthal Blue G XBT-583D, Heubach, Inc., Newark, NJ | 50.00 |
| Isopar ®-L, nonpolar liquid having a Kauri-butanol value of 27, Exxon Corporation | 1000.00 |

The ingredients were heated to 100° C.±10° C. and milled at a rotor speed of 230 rpm with 0.01875 inch (4.76 mm) diameter stainless steel balls for two hours. The attritor was cooled to ambient temperature while milling was continued and 700 grams of Isopar ®-L (Exxon) were added. Milling was continued and the average particle size was monitored. Particle size measured with the Malvern 3600 Particle Size Analyzer was 6.3 μm. This corresponded to a 16 hour cold grind. The particulate media were removed and the toner was diluted to 2% solids with additional Isopar ®-L and charged with 40 mg Basic Barium Petronate ® (BBP)/g of toner solids resulting in conductivity of 25 pmhos/cm. Image quality was determined using a modified Savin 870 copier set up to evaluate positive toners. The copier was run with a reversed image target and the following biases: development housing bias was +600 V and transfer corona was −6 kV. The image quality was very poor with almost no discernable image. Image showed areas of reversed image indicating that the toner was negatively charged and there was not enough image to measure resolution. Q/m measurement also showed toner was negatively charged with Q/m=−92 and the ratio of the deposited positive particle weights/deposited negative particle weights=0. Results are shown in Table 1 below.

CONTROL 2

The procedure of Control 1 was repeated with the following exceptions: no pigment was used. The toner was cold ground for a 6 hours with final Malvern 3600 Particle Size Analyzer average particle size of 9.0 μm. The toner was diluted to 2% solids with additional Isopar ®-L and charged with 40 mg Basic Barium Petronate ®/g of toner solids resulting in conductivity of 29 pmhos/cm. Image quality was determined using a modified Savin 870 copier set up to evaluate negative toners. The copier was run with a standard image target and the following biases: development housing bias was +500 V and transfer corona was +6 kV. Image quality showed a fair image and the toner was negatively charged. Q/m measurement also showed toner was negatively charged with Q/m=−159 and the ratio of the deposited positive particle weight/deposited negative particle weights=0 Results are shown in Table 1 below.

CONTROL 3

In a Union Process 01 Attritor, Union Process Company, Akron, Ohio, were placed the following ingredients:

| Ingredients | Amount (g) |
|---|---|
| Terpolymer of methyl acrylate (67.3%)/methacrylic acid (3.1%)/ethyl hexyl acrylate (29.6%) weight average molecular weight of 172,000, acid no. is 13 | 35.00 |
| Columbia Red Med, RD 2392 Paul Uhlich & Co., Hastings-On-Hudson, NY | 7.0 |
| Isopar ®-L, as described in Control 1 | 200.0 |

The ingredients were heated to 90° C. to 110° C. and milled 0.1875 inch (4.76 mm) diameter stainless steel balls for 2 hours. The attritor was cooled to ambient temperature while milling was continued. Milling was continued for 24.5 hours and the average particle size was 1.0 μm as measured on the Horiba CAPA-500 centrifugal automatic particle analyzer. The particulate media were removed and the dispersion of toner particles was then diluted to 2% solids with additional Isopar ®-L and charged with 266 mg Emphos ®D70-30C(EP)/g of toner solids) resulting in conductivity of 17 pmhos/cm. Images were made by means of a photoconducting film, e.g., such as are described in Mattor U.S. Pat. No. 3,314,788 and Paulin et al. U.S. Pat. No. 4,248,952, the disclosures of which are incorporated herein by reference, and which has a base support, 0.007 inch (0.18 mm) polyethylene terephthalate, bearing two layers, the outer layer being an organic photoconductive layer, and the inner layer next to the support being an electrically conductive layer such as aluminum, a portion of outer layer being removed along at least one edge thereof to define a strip of the conductive layer and on the exposed strip a conductive paint such as carbon black was placed so as to permit the conductive layer to be grounded. The photoconducting film used was passed over a −1000 V scorotron at 0.5 inch/second (1.27 cm/second), discharged selectively using a cathode ray tube, and toned with the developer using a developer filled gap between a −350 V development electrode and the charged film. The images were fused in an oven at 115° F. (46° C.) for 1 minute, and cooled to room temperature. Using the imaging method described in this control, reverse or negative images were obtained. Results are shown in Table 1 below.

CONTROL 4

The toner was prepared as described in Example 2 except for the following changes: 200 grams of Isopar ®-L and 88 grams of Isopar ®-H, and 0.9 gram of 1-hexadecanesulfonic acid (HDSA) was added in place of 2-bromoethanesulfonic acid, sodium salt. Milling was continued for 27 hours and the average particle size of 1.30 μm was measured on the Horiba CAPA-500 centrifugal automatic particle analyzer. The particulate media were removed and the dispersion of toner particles was then diluted to 2% solids with Isopar ®-L and charged with 40 mg Basic Barium Petronate ®/g of toner solids to obtain a conductivity of 19 pmhos/cm. Image quality was determined using a modified Savin 870 copier set up to evaluate positive toners. The copier was run with a reversed image target and the following biases: development housing bias was +600 V and transfer corona was −6 kV. Image quality was poor and image indicated that the toner was negatively charged. Image demonstrated 4 lp/mm resolution of unfilled lines and poor density. Q/m measurement also showed that the toner was negatively charged with Q/m = −66 and the ratio of the deposited positive particle weights/deposited negative particle weights = 0. Results are shown in Table 1 below. An equivalent weight amount of 1-hexadecanesulfonic acid (0.04% by weight based on the amount used in the 2% solids toner) is substantially soluble in Isopar ®-L, demonstrating that a salt soluble in the nonpolar liquid does not enhance positive charging. Results are shown in Table 2 below.

CONTROL 5

The procedure of Control 1 was repeated with the following exceptions: 0.80 gram of p-toluenesulfonic acid, Fisher Scientific, Pittsburgh, Pa. (pTSA), was added to the toner carrier liquid after dilution and no charge director was added resulting in conductivity of 0 pmho/cm. Image quality was determined using a modified Savin 870 copier set up to evaluate positive toners. The copier was run with a reversed image target and the following biases: development housing bias was +600 V and transfer corona was −6 kV. Image quality was poor with faint washed-out reversed image indicating that the toner was weakly positive or bipolar. Image demonstrated 10 lp/mm resolution but features were not filled in and density was very low. Q/m measurement showed toner was bipolar with Q/m = −4 and the ratio of the deposited positive particle weights/deposited negative particle weights = 0.09. Results are shown in Table 1 below.

CONTROL 6

The procedure of Control 1 was repeated with the following exceptions: 0.80 gram of p-toluene-sulfonic acid, Aldrich Chemical Co. (pTSA) was added to the toner carrier liquid after dilution and charging with 40 mg Basic Barium Petronate ®/g of toner solids resulting in conductivity of 26 pmhos/cm. Image quality was determined using a modified Savin 870 copier set up to evaluate positive toners. The copier was run with a reversed image target and the following biases: development housing bias was +600 V and transfer corona was −6 kV. Image quality was fair with reversed image indicating that the toner was negatively charged. The reversed image was blotchy with 10 lp/mm resolution of unfilled lines and fair density. Q/m measurement also showed toner was negatively charged with Q/m = −104 and the ratio of the deposited positive particle weights/deposited negative particle weights = 0. Results are shown in Table 1 below.

EXAMPLE 1

The procedure of Control 1 was repeated with the following exceptions: 51.28 grams of Heucophthal Blue G XBT-583D were used instead of 50.00. In addition 5.13 grams of p-toluenesulfonic acid, Fisher Scientific, Pittsburgh, Pa. (pTSA) was added at the beginning. The toner was cold ground for 17 hours with final Malvern 3600 Particle Size Analyzer average particle size of 4.0 μm. The toner was diluted to 2% solids with additional Isopar ®-L and charged with 40 mg Basic Barium Petronate ®/g of toner solids resulting in conductivity of 9 pmhos/cm. Image quality was determined using a modified Savin 870 copier set up to evaluate positive toners. The copier was run with a reversed image target and the following biases: development housing bias was +700 V and transfer corona was −6 kV. Image quality was very good and image indicated that the toner was positively charged. Image demonstrated 7 lp/mm resolution and good density. Q/m measurement also showed toner was positively charged with Q/m = +109 and the deposited negative particle weight was 0. An equivalent amount of p-toluenesulfonic acid (0.04% by weight based on the amount used in 2% solids toner) was substantially insoluble in Isopar ®-L. Results are shown in Table 1 below.

EXAMPLE 2

The following ingredients were placed in a Union Process 01 Attritor, Union Process Company, Akron, Ohio:

| Ingredients | Amount (g) |
|---|---|
| Copolymer of ethylene (89%) and methacrylic acid (11%) melt index at 190° C. is 100, acid no. is 66 | 35.00 |
| Isopar ®-L as described in Control 1 | 125.0 |
| Heucophthal Blue G XBT-583D, Heubach, Inc., Newark, NJ | 8.97 |
| 2-Bromoethanesulfonic acid, Na salt (Br ESA), Aldrich Chemical Co. | 0.90 |

The ingredients were heated to 90° C. to 110° C. and milled at a rotor speed of 230 rpm with 0.1875 inch (4.76 mm) diameter stainless steel balls for 2 hours. The attritor was cooled to ambient temperature while milling was continued and then 88 grams of Isopar ®-H (Exxon Corp.) was added. Milling was continued for 24.5 hours and the average Malvern 3600 Particle Size Analyzer particle size was 8.2 μm. The particulate media were removed and the dispersion of toner particles was then diluted to 2% solids with additional Isopar ®-L and charged with 40 mg Basic Barium Petronate ®/g of toner solids resulting in conductivity of 17 pmhos/cm. Image quality was determined using a modified Savin 870 copier set up to evaluate positive toners. The copier was run with a reversed image target and the following biases: development housing bias was +600 V and transfer corona was −6 kV. Image quality was very good and image indicated that the toner was positively charged. Image demonstrated 10 lp/mm resolution and good density. Q/m measurement also showed toner was positively charged with Q/m = +66 and the deposited negative particle weight was 0. An equivalent amount of 2-bromoethanesulfonic acid (0.04% by weight based on the amount used in 2% solids toner) was substantially insoluble in Isopar ®-L. Results are found in Table 1 below.

EXAMPLE 3

The procedure of Example 2 was repeated with the following changes: the Na salt of 3-hydroxy-1-propanesulfonic acid, Aldrich Chemical Co. (HOPSA) was used in place of the Na salt of 2-bromoethanesulfonic acid. The toner was cold ground for 23.5 hours with final average Malvern particle size of 7.0 μm. The toner was diluted to 2% solids with additional Isopar ®-L and charged with 40 mg Basic Barium Petronate ®/g of toner solids resulting in conductivity of 16 pmhos/cm. Image quality was determined using a modified Savin 870 copier set up to evaluate positive toners. The copier was run with a reversed image target and the following biases: development housing bias was +600 V and transfer corona was −6 kV. Image quality was very good and image indicated that the toner was positively charged. Image demonstrated 10 lp/mm resolution and good density. Q/m measurement also showed toner was positively charged with Q/m = +132 and the deposited negative particle weight was 0. An equivalent amount of Na salt of 3-hydroxy-1-propanesulfonic acid (0.04% by weight based on the amount used in 2% solids toner) was substantially insoluble in Isopar ®-L. Results are shown in Table 1 below.

EXAMPLE 4

The procedure of Example 1 was repeated with the following exceptions: the Barium salt of p-Toluenesulfonic acid, Aldrich Chemical Co. (BapTSA) was used in place of the p-toluenesulfonic acid. The toner was cold ground for 17 hours with final average particle size of 3.6 μm. The toner was diluted to 2% solids with additional Isopar ®-L and charged with 40 mg Basic Barium Petronate ®/g of toner solids resulting in conductivity of 14 pmhos/cm. Image quality was determined using a modified Savin 870 copier set up to evaluate positive toners. The copier was run with a reversed image target and the following biases: development housing bias was +600 V and transfer corona was −6 kV. Image quality was very good and image indicated that the toner was positively charged. Image demonstrated 10 lp/mm resolution and good density. Q/m measurement also showed toner was positively charged with Q/m = +309 and the ratio of the deposited positive particle weights/deposited negative particle weights = 12.5. An equivalent amount of the Ba salt of p-toluenesulfonic acid (0.04% by weight based on the amount used in 2% solids toner) was substantially insoluble in Isopar ®-L. Results are shown in Table 1 below.

EXAMPLE 5

The toner was prepared as described in Example 2 with the following exceptions: 200 grams of Isopar ®-L were used instead of 125 grams of Isopar ®-L and 88 grams of Isopar ®-H, and 0.9 gram of benzenesulfonic acid, Aldrich Chemical Co. (BzSA) was added in place of 2-bromoethanesulfonic acid, sodium salt. The ingredients were heated to 90° to 110° C. and milled for 3 hours. The attritor was cooled to an ambient temperature while milling was continued. Milling was continued for 27 hours and the average particle size of 1.59 μm was measured on the Horiba CAPA-500 centrifugal automatic particle analyzer. The particulate media were removed and the dispersion of toner particles was then diluted to 2% solids with additional Isopar ®-L and charged with 40 mg Barium Petronate ®/g of toner solids to obtain a conductivity of 6 pmhos/cm. Image quality was determined using a modified Savin 870 copier set up to evaluate positive toners. The copier was run with a reversed image target and the following biases: development housing bias was +600 V and transfer corona was −6 kV. Image quality was very good and the image indicated that the toner was positively charged. Q/m measurement also showed toner was positively charged with Q/m = +51 and the deposited negative particle weight was 0. An equivalent amount of benzenesulfonic acid (0.04% by weight based on the amount in 2% solids toner) was substantially insoluble in Isopar ®-L. Results are shown in Table 1 below.

EXAMPLE 6

The procedure of Example 2 was repeated with the following exceptions: 40 grams of resin were used instead of 35 grams, 0.82 g of paratoluenesulfonic acid was used instead of 2-bromoethanesulfonic acid, sodium salt and no pigment was added. In the cold milling step, 125 grams of additional Isopar ®-L were added instead of 88 grams. The toner was cold ground for 23 hours with final average particle size of 11.0 μm. The toner was diluted to 2% solids with additional Isopar ®-L and charged with 40 mg Basic Barium Petronate ®/g of toner solids resulting in conductivity of 250 pmhos/cm. Image quality was determined using a modified Savin 870 copier set up to evaluate positive toners. The copier was run with a reversed image target and the following biases: development housing bias was +500 V and transfer corona was −6 kV. Image quality was very good with reverse image indicating that the toner was positively charged. The image demonstrated toning of fine lines and good density. Lp/mm could not be determined due to the lack of pigment in the image. Q/m measurement also showed toner was positively charged with Q/m = +573 and the deposited negative particle weight was 0. An equivalent amount of paratoluenesulfonic acid (0.04% by weight based on the amount used in 2% solids toner) was substantially insoluble in Isopar ®-L. Results are shown in Table 1 below.

EXAMPLE 7

Toner was prepared as described in Control 3 except that 0.7 gram of p-toluenesulfonic acid (pTSA) was added during the hot step. Milling was continued for 22 hours and the average particle size was 1.4 μm as measured on the Horiba CAPA-500 centrifugal automatic particle analyzer. The dispersion was diluted, charged and evaluated. Evaluations were carried out as described in Control 3. Images showed good resolution, and grey scale. Results are shown in Table 1 below.

EXAMPLE 8

The procedure of example 2 was repeated with the following changes: sodium n-butyl sulphate, Lancaster Synthesis (NanBS) was used in place of the 2-bromoethanesulfonic acid. The toner was cold ground for 19 hours with final average Malvern 3600 Particle Size Analyzer particle size of 7.6 μm. The toner was diluted to 2% solids with additional Isopar ®-L and charged with 40 mg Basic Barium Petronate ®/g of toner solids resulting in conductivity of 10 pmhos/cm. Image quality was determined using a modified Savin 870 copier set up to evaluate positive toners. The copier was run with a reversed image target and the following biases: development housing bias was +1000 V and transfer corona was −6 kV. Image quality was good and image indicated that the toner was positively charged. Image demonstrated 8.5 lp/mm resolution and good density. Q/m = +30.1 and the ratio of the deposited positive particle weights/deposited negative particle weights = 140. Results are found in Table 1 below.

TABLE 1

| EX | ADJ | PIG 9% | CD (mg/g) | BULK (pmho/cm) | O/M |
|---|---|---|---|---|---|
| C1 | | Cy(20)[2] | BBP(40) | 25 | −92 |
| C2 | | | BBP(40) | 29 | −159 |
| C3 | | RD(16)[3] | EP(266) | 17 | −2.63 |
| C4 | HDSA | Cy(20) | BBP(40) | 19 | −66 |
| C5 | pTSA[1] | Cy(20) | | 0 | −4 |
| C6 | pTSA[1] | Cy(20) | BBP(40) | 26 | −104 |
| E1 | pTSA | Cy(20) | BBP(40) | 9 | +109 |
| E2 | BrESA | Cy(20) | BBP(40) | 17 | +66 |
| E3 | HOPSA | Cy(20) | BBP(40) | 16 | +132 |
| E4 | BapTSA | Cy(20) | BBP(40) | 14 | +309 |

TABLE 1-continued

| EX | ADJ | PIG 9% | CD (mg/g) | BULK (pmho/cm) | O/M |
|---|---|---|---|---|---|
| E5 | BzSA | Cy(20) | BBP(40) | 6 | +51 |
| E6 | pTSA | | BBP(40) | 250 | +573 |
| E7 | pTSA | RD(16) | EP(266) | 20 | +1500 |
| E8 | NanBS | Cy(20) | BBP(40) | 10 | +30 |

[1]added after dilution
[2]Cy is cyan
[3]RD is red

TABLE 2

| Sulfur-Containing Compound | Solubility in non-polar Liquid | Effect |
|---|---|---|
| p-toluenesulfonic Acid | I | + |
| p-toluenesulfonic Acid, Ba Salt | I | + |
| Hydroxypropanesulfonic Acid, Na Salt | I | + |
| Bromoethanesulfonic Acid, Na Salt | I | + |
| Benzenesulfonic Acid | I | + |
| Hexadecanesulfonic Acid | S | |
| Sodium n-butylsulphate | I | + |

We claim:

1. A positive electrostatic liquid developer having improved charging and imaging characteristics consisting essentially of (A) a nonpolar liquid having a Kauri-butanol value of less than 30, present in a major amount, (B) thermoplastic resin particles having an average by area particle size of less than 10 μm having dispersed therein an adjuvant which is substantially insoluble in the nonpolar liquid at ambient temperatures and is an organic sulfur-containing compound selected from the group consisting of

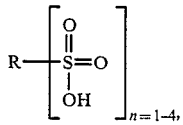
(1)

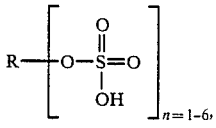
(2)

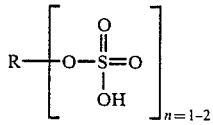
(3)

and (4) the salts of (1), (2) and (3), wherein R is alkyl of 1 to 30 carbon atoms, substituted alkyl of 1 to 30 carbon atoms, aryl of 6 to 30 carbon atoms, or substituted aryl of 6 to 30 carbon atoms, and (C) a nonpolar liquid soluble ionic or zwitterionic charge director compound.

2. An electrostatic liquid developer according to claim 1 wherein the sulfur-containing compound is of the formula:

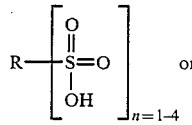
(1) or the salts of (1)

wherein R is alkyl of 1 to 30 carbon atoms, substituted alkyl of 1 to 30 carbon atoms, aryl of 6 to 30 carbon atoms, or substituted aryl of 6 to 30 carbon atoms.

3. An electrostatic liquid developer according to claim 2 wherein the sulfur-containing compound is p-toluenesulfonic acid.

4. An electrostatic liquid developer according to claim 2 wherein the sulfur-containing compound is barium p-toluenesulfonic acid.

5. An electrostatic liquid developer according to claim 1 wherein the sulfur-containing compound is of the formula:

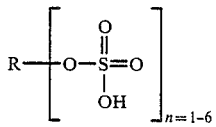
(2) or the salts of (2)

wherein R is alkyl of 1 to 30 carbon atoms, substituted alkyl of 1 to 30 carbon atoms, aryl of 6 to 30 carbon atoms, or substituted aryl of 6 to 30 carbon atoms.

6. An electrostatic liquid developer according to claim 5 wherein the sulfur-containing compound is sodium n-butylsulfate.

7. An electrostatic liquid developer according to claim 5 wherein the sulfur-containing compound is sodium decylsulfate.

8. An electrostatic liquid developer according to claim 1 wherein component (A) is present in 85 to 99.9% by weight, based on the total weight of liquid developer, the total weight of developer solids is 0.1 to 15.0% by weight, and component (C) is present in an amount of 0.1 to 10,000 mg/g developer solids.

9. An electrostatic liquid developer according to claim 8 wherein the sulfur-containing compound is present in 0.1 to 10% by weight based on the total weight of the developer solids.

10. An electrostatic liquid developer according to claim 1 containing up to about 60% by weight of a colorant based on the total weight of developer solids.

11. An electrostatic liquid developer according to claim 10 wherein the colorant is a pigment.

12. An electrostatic liquid developer according to claim 10 wherein the colorant is a dye.

13. An electrostatic liquid developer according to claim 1 wherein an inorganic fine particle oxide is present.

14. An electrostatic liquid developer according to claim 1 wherein an additional compound is present which is an adjuvant selected from the group consisting of polybutylene succinimide, aromatic hydrocarbon and alkylhydroxybenzylpolyamine.

15. An electrostatic liquid developer according to claim 10 wherein an additional compound is present which is an adjuvant selected from the group consisting of polybutylene succinimide, aromatic hydrocarbon and alkylhydroxybenzylpolyamine.

16. An electrostatic liquid developer according to claim 14 wherein a polybutylene succinimide adjuvant compound is present.

17. An electrostatic liquid developer according to claim 14 wherein an aromatic hydrocarbon adjuvant compound is present.

18. An electrostatic liquid developer according to claim 1 wherein the thermoplastic resin is a copolymer of ethylene and an $\alpha,\beta$-ethylenically unsaturated acid selected from the group consisting of acrylic acid and methacrylic acid.

19. An electrostatic liquid developer according to claim 1 wherein the thermoplastic resin is polystyrene.

20. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

21. An electrostatic liquid developer according to claim 10 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

22. An electrostatic liquid developer according to claim 20 wherein the thermoplastic resin is a copolymer of ethylene (89%)/methacrylic acid (11%) having a melt index at 190° C. of 100.

23. An electrostatic liquid developer according to claim 1 wherein the particles have an average by area particle size of less than 5 μm.

24. An electrostatic liquid developer according to claim 1 wherein component (C) is an oil-soluble petroleum sulfonate.

25. An electrostatic liquid developer according to claim 1 wherein component (C) is lecithin.

26. A process for preparing a positive electrostatic liquid developer for electrostatic imaging comprising (A) dispersing at an elevated temperature in a vessel a thermoplastic resin, sulfur-containing compound of the formula selected from the group consisting of

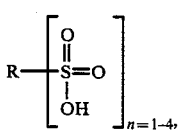

(1)

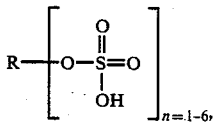

(2)

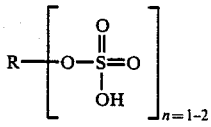

(3)

and (4) the salts of (1), (2) and (3), wherein R is alkyl of 1 to 30 carbon atoms, substituted alkyl of 1 to 30 carbon atoms, aryl of 6 to 30 carbon atoms, or substituted aryl of 6 to 30 carbon atoms; and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion, either (1) without stirring to form a gel or solid mass, followed by shredding the gel or solid mass and grinding by means of particulate media with or without presence of additional liquid;

(2) with stirring to form a viscous mixture and grinding by means of particulate media with or without the presence of additional liquid; or (3) while grinding by means of particulate media to prevent the formulation of a gel or solid mass with or without the presence of additional liquid;

(C) separating the dispersion of toner particles having an average by area particle size of less than 10 μm from the particulate media, and (D) adding to the dispersion during or subsequent to Step A a nonpolar liquid soluble ionic or zwitterionic change director compound.

27. A process according to claim 26 wherein the sulfur-containing compound is of the formula

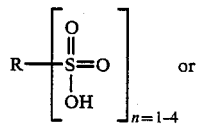

(1) or the salts of (1)

wherein R is alkyl of 1 to 30 carbon atoms, substituted alkyl of 1 to 30 carbon atoms, aryl of 6 to 30 carbon atoms, or substituted aryl of 6 to 30 carbon atoms.

28. A process according to claim 27 wherein the sulfur-containing compound is p-toluenesulfonic acid.

29. A process according to claim 27 wherein the sulfur-containing compound is barium p-toluenesulfonic acid.

30. A process according to claim 26 wherein the sulfur-containing compound is the sulfur-containing compound is of the formula

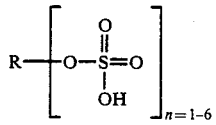

(2) or the salts of (2)

wherein R is alkyl of 1 to 30 carbon atoms, substituted alkyl of 1 to 30 carbon atoms, aryl of 6 to 30 carbon atoms, or substituted aryl of 6 to 30 carbon atoms.

31. A process according to claim 30 wherein the sulfur-containing compound is sodium n-butylsulfate.

32. A process according to claim 30 wherein the sulfur-containing compound is sodium decylsulfate.

33. A process according to claim 26 wherein there is present in the vessel up to 100% by weight of a polar additive having a Kauri-butanol value of at least 30, the percentage based on the total weight of the liquid.

34. A process according to claim 26 wherein the particulate media are selected from the group consisting of stainless steel, carbon steel, ceramic, alumina, zirconium, silica and sillimanite.

35. A process according to claim 26 wherein the thermoplastic resin is a copolymer of ethylene and an $\alpha,\beta$-ethylenically unsaturated acid selected from the group consisting of acrylic acid and methacrylic acid.

36. A process according to claim 26 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

37. A process according to claim 36 wherein the thermoplastic resin is a copolymer of ethylene (89%) methacrylic acid (11%) having a melt index at 190° C. of 100.

38. A process according to claim 26 wherein at least one colorant is present in dispersing step (A), and the temperature is maintained in the vessel at a temperature sufficient to plasticize and liquify the resin and below that at which the dispersant nonpolar liquid degrades and the resin and colorant decomposes.

39. A process according to claim 26 wherein the charge director compound is an oil-soluble petroleum sulfonate.

40. A process according to claim 26 wherein the charge director is lecithin.

41. A process according to claim 26 wherein the additional dispersant nonpolar liquid polar liquid or combinations thereof is present to reduce the concentration of toner particles to between 0.1 to 15 percent by weight with respect to the liquid.

42. A process according to claim 41 wherein the concentration of toner particles is reduced by additional dispersant nonpolar liquid.

43. A process according to claim 26 wherein cooling the dispersion is accomplished while grinding by means of particulate media to prevent the formation of a gel or solid mass with or without the presence of additional liquid.

44. A process according to claim 26 wherein cooling the dispersion is accomplished without stirring to form a gel or solid mass, followed by shredding the gel or solid mass and grinding by means of particulate media with or without the presence of additional liquid.

45. A process according to claim 26 wherein cooling the dispersion is accomplished with stirring to form a viscous mixture and grinding by means of particulate media with or without the presence of additional liquid.

46. A process according to claim 26 wherein an adjuvant compound selected from the group consisting of polybutylene succinimide, aromatic hydrocarbon, and alkylhydroxybenzylpolyamine is added to the liquid developer.

47. A process according to claim 38 wherein an adjuvant compound selected from the group consisting of polybutylene succinimide and an aromatic hydrocarbon, and alkylhydroxybenzylpolyamine is added to the liquid developer.

48. A process for preparing electrostatic liquid developer comprising (A) dispersing an organic sulfur-containing compound of the formula selected from the group consisting of

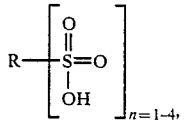

(1)

-continued

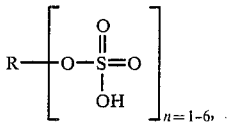

(2)

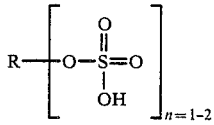

(3)

and (4) the salts of (1), (2) and (3), wherein R is alkyl of 1 to 30 carbon atoms, substituted alkyl of 1 to 30 carbon atoms, aryl of 6 to 30 carbon atoms, substituted aryl of 6 to 30 carbon atoms, or substituted aryl of 6 to 30 carbon atoms, in a thermoplastic resin in the absence of a dispersent nonpolar liquid having a Kauri-butanol value of less than 30 to form a solid mass, (B) shredding the solid mass, (C) grinding the shredded solid mass by means of particulate media in the presence of a liquid selected from the group consisting of a polar liquid having a Kauri-butanol value of at least 30, a nonpolar liquid having a Kauri-butanol value of less than 30, and combinations thereof, (D) separating the dispersion of toner particles having an average by area particle size of less than 10 μm from the particulate media, and (E) adding additional nonpolar liquid, polar liquid or combinations thereof to reduce the concentration of toner particles to between 0.1 to 15.0 percent by weight with respect to the liquid; and (F) adding to the dispersion a liquid soluble ionic or zwitterionic charge director compound.

49. A process for preparing electrostatic liquid developer comprising (A) dispersing an organic sulfur-containing compound of the formula selected from the group consisting of

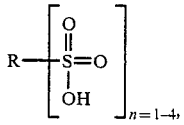

(1)

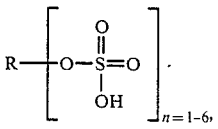

(2)

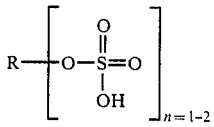

(3)

and (4) the salts of (1), (2) and (3), wherein R is alkyl of 1 to 30 carbon atoms, substituted alkyl of 1 to 30 carbon atoms, aryl of 6 to 30 carbon atoms, substituted aryl of 6 to 30 carbon atoms, or substituted aryl of 6 to 30 carbon atoms, in a thermoplastic resin in the absence of a dispersant nonpolar liquid having a Kauri-butanol value of less than 30 to form a solid mass, (B) shredding the solid mass, (C) redispersing the shredded solid mass at an elevated temperature in a vessel in the presence of a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (D) cooling the dispersion, either (1) without stirring to form a gel or solid mass, followed by shredding the gel or solid mass and grinding by means of particulate media with or without the presence of additional liquid;

(2) with stirring to form a viscous mixture and grinding by means of particulate media with or without the presence of additional liquid; or (3) while grinding by means of particulate media to prevent the formulation of a gel or solid mass with or without the presence of additional liquid;

(E) separating the dispersion of toner particles having an average by area particle size of less than 10 $\mu$m from the particulate media, and (F) adding addition nonpolar liquid, polar liquid or combinations thereof to reduce the concentration of toner particles to between 0.1 to 15.0 percent by weight with respect to the liquid; and (G) adding to the dispersion a liquid soluble ionic or zwitterionic charge director compound.

50. A process according to claim 49 wherein at least one colorant is present in redispersing step (C), and the temperature is maintained in the vessel at a temperature sufficient to plasticize and liquify the resin and below that at which the dispersant nonpolar liquid degrades and the resin and colorant decomposes.

* * * * *